US005909776A

United States Patent [19]

Stewart et al.

[11] Patent Number: 5,909,776

[45] Date of Patent: Jun. 8, 1999

[54] FIRE EXTINGUISHERS

[75] Inventors: Harry E. Stewart, Malvern; Donald B. MacElwee, Wayne, both of Pa.

[73] Assignee: Powsus Inc., Malvern, Pa.

[21] Appl. No.: 08/835,813

[22] Filed: Apr. 16, 1997

[51] Int. Cl.[6] ..... A62C 35/10

[52] U.S. Cl. ..... 169/26; 169/62

[58] Field of Search ..... 169/26, 62

[56] References Cited

U.S. PATENT DOCUMENTS 3,486,563 12/1969 Cholin et al. ..... 169/26

3,827,502 8/1974 Lockwood ..... 169/26

4,938,293 7/1990 Warren et al. ..... 169/62

5,678,638 10/1997 Baker ..... 169/26

*Primary Examiner*—Gary C. Hoge

*Attorney, Agent, or Firm*—Kane, Dalsimer, Sullivan, Kurucz, Levy, Eisele and Richard, LLP

[57] ABSTRACT

The linear type fire-extinguisher is modified to be fabricated from a synthetic polymeric resin, rupturable upon combustion to release a contained fire-extinguisher.

16 Claims, 2 Drawing Sheets

FIRE EXTINGUISHERS

BACKGROUND OF THE INVENTION

1. Field of the Invention

The invention relates to fire extinguishing apparatus and more particularly to a linear type distribution extinguisher.

2. Brief Description of the Related Art

Extinguishing open flames within a confined space such as a room in a building, an engine compartment in a vehicle, aircraft interiors, enclosed fuel storage areas, electric control boxes, storage containers, hazardous material storage facilities and the like has always posed problems of speed in extinguishing and clean-up requirements after the flame is extinguished. The first problem is related to placement of a fire extinguishing composition at the flame site, in sufficient quantity to extinguish a flame rapidly and on demand. The second problem is related to the nature of the fire extinguisher composition and its residues after flame extinction.

The present invention utilizes a known fire-extinguisher composition selected to minimize the second problem, i.e, clean-up of toxic and non-toxic residues of the extinguisher composition. However, the placement of the fire extinguishing composition at the required site, in a defined space is carried out using the apparatus of the present invention. A "defined space" as used herein is not limited to a closed, enclosed area but includes an open area defined by dimensions, such as for example a sanitation landfill area. The apparatus of the invention can be used in both the "flooding" and the "streaming" methods of application.

Burstable thermoplastic tubes containing pressurized liquids have been used as sensors to activate mechanical apparatus by depressurization of the liquid. For example, U.S. Pat. No. 5,276,433 describes such a sensor which will burst and depressurize when the contained liquid boils. The boiling occurs upon exposure to elevated ambient temperature, bursting the tube container. Representative of the contained liquids mentioned in the patent are the Halons such as Halon 1211 and Halon 1301. Halon 1211 and Halon 1301 are brominated hydrocarbons which were once widely used as fire extinguishers until recognized for their potential for destroying ozone in the upper stratosphere, when released into the environment. This impact on the environment has been of great concern.

Subsequently, some 90 countries participated in a treaty to phase out use of the ozone-destroying bromofluorocarbons such as those widely used in commercial applications, including as fire extinguishers. Thus, the Halons are no longer considered as fire extinguishing compositions. In addition, the device of U.S. Pat. No. 5,276,433 never contemplated using the Halon liquid in quantities necessary for flame extinction.

The term "flame temperature" as used herein means the temperature of a selected flame, to be protected against and extinguished upon eruption. the exact temperature of a given flame will, of course, depend on the nature of the fuel source for the flame and the availability of oxygen for combustion at the flame site. For example, flame produced by ignition of phosphorus will differ in temperature from the flame produced by combustion of a hydrocarbon. Those skilled in the art are aware of the differences in flame temperature depending on the flame source and are also aware of the flame temperatures necessary to soften synthetic polymeric resin tubular components to a point where rupture of a given container under pressure occurs. In general, a flame temperature will be within a range of from about 30° C. to about 1500° C. depending on the flame source.

SUMMARY OF THE INVENTION

The invention comprises a linear fire extinguisher system, which comprises;

(a) an elongated tubular container with closed first and second ends;

said tubular container with first and second ends having side walls defining a closed, elongate chamber;

said tubular container side walls being molded of a thermoplastic, synthetic polymeric resin; and said container walls being adapted by size and material of fabrication to rupture under super-atmospheric pressures upon reaching a flame temperature; and (b) an effective proportion of a flame extinguishing fluid fire extinguishing composition contained in the elongate chamber under super-atmospheric pressures at temperatures below a flame temperature.

DETAILED DESCRIPTION OF THE PREFERRED EMBODIMENTS OF THE INVENTION

Those skilled in the art will gain an appreciation of the invention from a reading of the following description of preferred embodiments of the invention when accompanied by a viewing of the drawings of FIGS. 1–4, inclusive.

Figure 1:
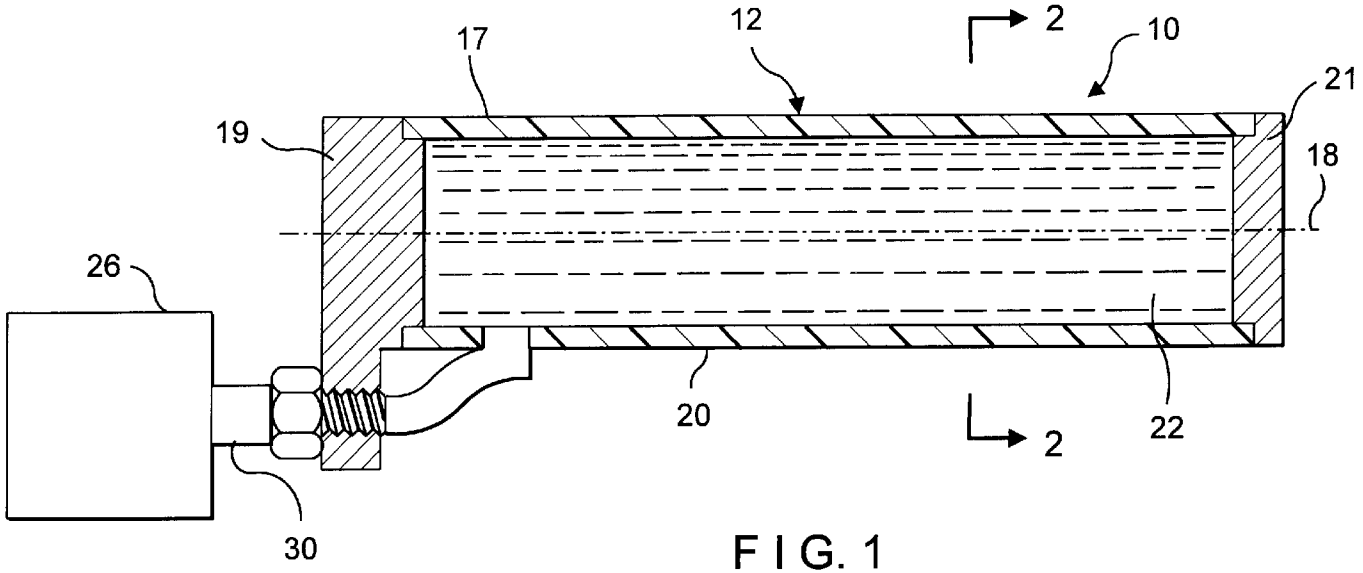
FIG. 1 is a schematic plan view of a linear type extinguisher system, employing an extinguisher apparatus of the invention.

FIG. 1 is a schematic plan view of a linear type fire extinguishing system, employing extinguisher apparatus of the invention. The extinguisher system 10 comprises an extinguisher head 12 which is an elongated tubular container 17 with closed first and second ends 19, 21. The container 17 has side walls 20 which together with ends 19, 21 define a closed, interior, elongate chamber 22. The tubular container 17 may be molded by conventional technique, from a thermoplastic, synthetic polymer resin.

The closed elongate chamber 22 of FIG. 1 is in open communication through pressure-resistant conduit 30 to an optional storage vessel 26, for containment of an optional supply of fluid fire-extinguishing composition 18 under super-atmospheric pressures. Alternatively, for relatively small flame sites, the tubular chamber may contain the entire volume of fire-extinguishing composition. The fire extinguishing composition 18 is present in the chamber 22 and in the vessel 26 in an effective proportion to extinguish a flame should it occur at the site of the "defined space". Those skilled in the art of fire-extinguishing are familiar with the calculations used to determine the proportions necessary for specific and given circumstances, depending on the expected flame sources, areas to be covered and specifics of area confinement at a given site. For example, an effective proportion for an electric control box about 4'×4'×1' (16 cubic feet) may be as little as 2 lbs. of the composition of Preparation 1, infra. On the other hand, a flooding application in a storage area of 30'×30'×20' (18,000 cubic feet) for hydrocarbon fluids may require 4,500 lbs. of a perfluorocarbon gas.

The elongate tubular container 17 is light weight, flexible and resistant to the super-atmospheric pressures at ambient temperatures, i.e. at temperature below about 30° C. This stability and resistance to super-atmospheric temperatures at ambient temperatures is important, enabling the apparatus of the invention to be used in a wide range of natural environments without activation. For example, the apparatus of the invention will not activate in the absence of flame in hot engine compartments, in the southwestern deserts or at high altitudes. Those skilled in the art will appreciate designs for specific locations. In addition, container 17 is substantially impermeable to leakage of the fire-extinguishing compositions 18 they contain. These requirements call for a selection of the synthetic polymeric resin material of container 17 fabrication and wall 20 thickness. Representative of synthetic resins and associated extruded wall 20 thickness are as follows:

| Resin | Wall Thickness |
|---|---|
| polyamide (nylon 12, 12) | 1.0–4.0 mm |
| polyamide (nylon 12) | 1.0–4.0 mm |

The above selected synthetic polymeric resin containers 17 with wall 20 thickness within the above stated parameters, upon exposure to flame temperature, i.e; open flame with temperatures of from about 100° C. to about 180° C. will soften and rupture under the above-described super-atmospheric pressures. For example, nylon 12, 12 containers with a wall thickness of about 1.0 mm, containing a fire-extinguishing fluid composition under a pressure of about 80 PSI will soften and rupture when exposed to open flame of a temperature of about 100° C.

Figure 2:
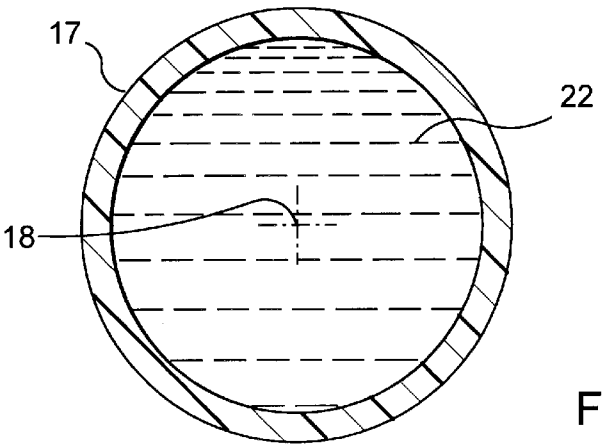
FIG. 2 is an enlarged cross-sectional side elevation view along lines 2—2 of the extinguisher apparatus shown in FIG. 1.

FIG. 2 is an enlarged view along lines 2—2 of FIG. 1, showing in cross-section the fire extinguishing apparatus 12 of the invention. The elongate chamber 22 is filled to capacity with a fluid fire-extinguishing composition 18 under super-atmospheric pressures. The term "super-atmospheric pressures" as used herein may include pressures of from 1.2 to 10 atmospheres; preferably 2 to 5 atmospheres. The fire extinguishing composition 18 may be any of the known fire-extinguishing compositions which are fluid under the described super-atmospheric pressure conditions. For flooding application, i.e., to flood a chamber or closed space with a fire extinguisher, the fire-extinguishing composition is preferably a perfluorocarbon, hydrochlorofluorocarbon or hydrofluorocarbon gas.

Representative of these perfluorocarbons, hydrochlorofluorocarbons and hydrofluorocarbons are 2-chloro-1,1,1,2-tetrafluoroethane, pentafluoroethane, 1,1,2,2-tetrafluoroethane, 1,1,1,2-tetrafluoroethane, 1,1,1-trifluoroethane, perfluorocyclopropane, perfluoropropane, perfluorocyclobutane and the like; see U.S. Pat. No. 5,135,054, which is incorporated herein by reference thereto. The hydrofluorocarbons are referred to by the "HFC" system. Under this system, the first digit represents the number of carbon atoms minus one (and is omitted if zero); the second digit represents the number of hydrogen atoms plus one; and the third digit represents the number of fluorine atoms, for example, HFC-125 represents pentafluoroethane.

Advantageously, the fire extinguishing composition is one containing a dispersion of dry powder fire extinguishing agent for other than flood applications, i.e., in streaming and local applications (where the agent is applied from extinguishers which direct a stream of the agent on the fire site).

Dry powder-fire-extinguishing agents are represented by ammonium sulfate, sodium carbonate, potassium carbonate, sodium bicarbonate, potassium bicarbonate, ammonium borate, potassium borate, sodium borate (borax), sodium sulfate, sodium phosphate, sodium polyphosphate, sodium chloride, potassium chloride, ammonium bromide, mono- and diammonium phosphate and the like. Preferred dry powder fire-extinguishing agents are solid forms of the ammonium and sodium salts of polyphosphoric acids (ammonium or sodium polyphosphate). The ammonium polyphosphate solid particles are preferred dry chemical agents for practice of the present invention, since they are inherently polyanions which repel each other, avoiding self-agglomeration. Advantageously, the ammonium polyphosphate solid particles employed in the method of the invention are prepared by methods well-known in the art, for example, by heat treating phosphates such as urea phosphate with a combined ammoniating and condensing agent such as urea or melamine. Further details of the commercial preparation of ammonium polyphosphates may be found in U.S. Pat. Nos. 3,755,163 and 3,775,315, both incorporated herein by reference thereto. These ammonium polyphosphates are compounds containing a P-O-P type linkage, having the general formula:

$$(NH_4)_n+2P_nO_{3n+1} \quad (I)$$

wherein n is an integer of at least about 17. The physical characteristics of these ammonium polyphosphates and the various processes for preparing them are described, for example, in U.S. Pat. No. 3,397,035 dated Aug. 13, 1968. Water solubility of the polyphosphate is increased as the degree of ammoniation is lowered and as the polymer chain length is decreased.

Especially good results are obtained with the use of ammonium polyphosphates of formula (I) given above, having an n value between 1000 and 5000, preferably between 1000 and 3000.

The preferred ammonium polyphosphates used in the present invention are solids and have an apparent density between about 0.4 and 0.9 kg/liter, as compared with other powdered fire-extinguishing agents having an apparent density between about 0.4 and 0.45 kg/liter. A phosphorus content of 31.5±0.5% by weight and a water-soluble content of less than 10% measured in a 10% strength aqueous dispersion at a temperature of 25° C. is advantageous.

The particles are advantageously provided in the form of free-flowing, finely divided particles, (crystals or granules), the average particle size being a maximum of 500 microns, advantageously within the range of from about 0.05 to 500 microns, preferably 1 to 100 microns, most preferably less than about 50 microns. Especially good results are obtained in flooding applications using particle sizes of 1 to 12 microns (average).

The particles of dry powder fire-extinguishing agents are uniformly and homogeneously dispersed in a volatile liquid gel. Any of the known perfluorocarbon, chlorofluorocarbon and hydrofluorocarbon fire-extinguishing gases of low ozone depletion potential may be used as the gellable liquid in compounding the compositions. Representative of those gases are HFC-23, HFC-31, HFC-32, HFC-124, HFC-125, HFC-134, HFC-134a, HFC-218, HFC-227ea, HFC-318, HFC-236fa and the like (see U.S. Pat. No. 5,185,094 incorporated by reference).

The proportion of volatile liquid in the gel compositions may range from about 30 to about 99 percent by weight of the total gel composition, preferably 40 to 98 percent. Gelling agents for use in gelling non-aqueous dispersions of dry powdered fire-extinguishing agents in organic liquids are well known and include for example pyrogenic silica (such as the commercially available CAB-O-SIL H5 marketed by G. L Cabot, Inc., Boston, Mass.; pyrogenic alumina (such as Alan C); carboxymethyl cellulose, carrageenin, polycarboxylated vinyl polymers such as carboxypolymethylene and those described in U.S. Pat. No. 4,652,383, incorporated herein by reference thereto, guar gum and the like. A preferred gelling agent is fumed silica/alumina (Coke®-84; DeGussa, Inc. Teterboro, N.J.).

The gelling agents are present in the compositions in an amount sufficient to effect gelation of the liquid ingredients. Advantageously, the proportion of gelling agent used is within the range of from 0.05 to 10 percent by weight of the volatile liquid. Gelation is preferably the formation of a thixotropy, having a yield stress of at least about 200 dynes per $cm^2$. Unexpectedly, we found that when the dry particle ingredients have an average size of from 1 to about 12 microns, the amount of gelling agent required to effect gelation of the liquid ingredient is dramatically reduced, i.e.; requiring about one-tenth the amount needed for compositions containing dry particles of larger particle sizes.

The gelling causes the gas and dry particles to "hang together". As a result, the volatile liquid effectively carries the dry powder ingredients directly to the fire, around corners and through clutter (places where nitrogen gas propelled powder compositions generally cannot be directed).

The HALON type gases have formed relatively stable gel compositions, without the use of stabilizing additives. This is not the case when substituting hydrofluorocarbons and chlorofluorocarbons for HALONS, in gel compositions. Due to the differences in polarity and solvent power, of gelled hydrofluorocarbons or hydrochlorofluorocarbons, the suspended dry particles have a tendency to agglomerate in the gelled, liquefied volatile gas. Agglomeration of the particles can clog the point of dispensation, resulting in an inefficient application. To overcome this tendency for particle agglomeration, one may incorporate into the gel compositions a surfactant and deflocculant system comprised of a plurality of particular and specified surfactants. The surfactant system stabilizes the gel composition and prevents agglomeration and separation of the solid particles from the dispersion.

The term "surfactant" as used herein is a contraction of "surface-active agent" and is a broadly descriptive term used to describe a chemical compound which is (1) soluble in at least one phase of a system, (2) has an amphipathic structure, (3) the molecules of which form oriented monolayers at phase interfaces, (4) exhibits an equilibrium concentration as a solute at a phase interface, greater than its concentration in the bulk of the solution, (5) forms micelles when the concentration as a solute in solution, exceeds a characteristic limiting value and (6) exhibits some combination of the functional properties of detergency, foaming, wetting, emulsifying, solubilizing and dispersing. The surfactants for combination in the gel carriers of the present invention are chosen for their primary functions as polarization neutralizers, lubricants and wetting agents. In the gelled carrier described herein, the formulation with dry fire extinguisher powders is stable for optimal periods of time, to enhance dispensing of the fire extinguishant and to promote rapid extinguishing of flames.

In a gelled composition, a non-ionic hydrophilic surfactant may be included to assist in stabilizing the dispersion of the dry particles in the gel.

As examples of hydrophilic, non-ionic surfactant, there may be mentioned polyoxyethylene sorbitan fatty acid ester such as polyoxyethylene sorbitan monooleate, polyoxyethylene sorbitan monostearate, or polyoxyethylene sorbitan tetraoleate; polyoxyethylene sorbitol fatty acid ester such as polyoxyethylene sorbitol monolaurate, polyoxyethylene sorbitol monooleate, polyoxyethylene sorbitol pentaoleate, or polyoxyethylene sorbitol monostearate; polyoxyethylene glycerol fatty acid ester such as polyoxyethylene glycerol monostearate, polyoxyethylene glycerol monoisostearate, or polyoxyethylene glycerol triisostearate; polyoxyethylene fatty acid ester such as polyoxyethylene monooleate, polyoxyethylene distearate, polyoxyethylene monodioleate, or ethylene glycol distearate; polyoxyethylene alkyl ether such as polyoxyethylene lauryl ether, polyoxyethylene oleyl ether, polyoxyethylene stearyl ether, polyoxyethylene behenyl ether, polyoxyethylene 2-octyl dodecyl ether, or polyoxyethylene cholestanol ether; polyoxyethylene alkyl phenyl ether such as polyoxyethylene octyl phenyl ether, polyoxyethylene nonyl phenyl ether, or polyoxyethylene dinonyl phenyl ether; pluronic-type surface-active agent such as pluronic; polyoxyethylene polyoxypropylene alkyl ether such as polyoxyethylene polyoxypropylene cetyl ether, polyoxyethylene polyoxypropylene 2-decyl tetradecyl ether, polyoxyethylene polyoxypropylene monobutyl ether, polyoxyethylene polyoxypropylene hydrogenated lanolin, or polyoxyethylene polyoxypropylene glycerol ether; tetrapolyoxyethylene tetrapolyoxypropylene ethylene diamine condensate such as tetronic; polyoxyethylene castor oil or hardened castor oil derivatives such as polyoxyethylene castor oil, polyoxyethylene hardened castor oil monoisostearate, polyoxyethylene hardened castor oil truisostearate, polyoxyethylene hardened castor oil monopyroglutamic acid monoisostearic acid diester, or polyoxyethylene hardened castor oil maleic acid; polyoxyethylene bees wax laurin derivatives such as polyoxyethylene sorbitol bees wax; alkanol amide such as coconut oil fatty acid diethanol amide, lauric acid monoethanol amide, or fatty acid isopropanol amide; polyoxyethylalkyl amine, polyoxyethylene fatty acid amide, sucrose fatty acid ester, polyoxyethylene nonyl phenyl formamide condensate, alkyl ethoxy dimethylamine oxide, trioleyl phosphate, and the like.

The non-ionic surfactant is advantageously present in a weight proportion of from about 0.5 to 10 percent by weight of the total weight of gelled composition of the invention, preferably less than 5 percent.

It is also advantageous, when the dry particles to be dispersed in the gel composition are polar materials, to counter the polarity of the particles. This can be accomplished by adding to the compositions a depolarizing proportion of an anionic surfactant. Representative of anionic surfactants are surfactant compounds which contain an organic hydrophobic group containing from about 8 to 26 carbon atoms and preferably from about 10 to 22 carbon atoms in their molecular structure; and at least one water-solubilizing group selected from the group consisting of sulfonate, sulfate and carboxylate so as to form a water-soluble surfactant.

Examples of anionic surfactants include soaps, such as, the water-soluble salts (e.g., the sodium, potassium, ammonium and alkanol-ammonium salts) of higher fatty acids containing from about 8 to 20 carbon atoms.

Other anionic surfactants are the alkane sulfonates including long chain alkane sulfonates and long chain hydroxyalkane sulfonates. Also the sulfated ethoxylated higher fatty alcohols of the formula RO $(C_2H_4O)_mSO_3M$, wherein R is a fatty alkyl of from 10 to 22 carbon atoms, m is from 2 to 6 (preferably having a value from about ⅕ to ½ the number of carbon atoms in R) and M is a solubilizing salt-forming cation, such as an alkali metal, ammonium, lower alkylamino or lower alkanolamino, or higher alkyl benzene sulfonate wherein the higher alkyls of 10 to 15 carbon atoms are present. The proportion of ethylene oxide in the polyethoxylated higher alkanol sulfate is preferably 2 to 5 moles of ethylene oxide groups per mole of anionic surfactant, with three moles being most preferred, especially when the higher alkanol is of 11 to 15 carbon atoms.

Another class of preferred anionic surfactant found useful as a component of the fire-extinguishing compositions are the sulfonates of formula:

$$RSO^-_3Na^+$$

wherein R is a hydrocarbyl group. Representative of such sulfonates are sodium xylene sulfonate, sodium lauryl sulfate and the like.

A depolarizing amount of anionic surfactant is generally from about 0.5 to about 10.0 percent by weight of the total weight of the gel composition.

Minor amounts (0.001 to 0.5 parts by weight of the total gel composition) of film-forming surfactants such as the fluorocarbons described in U.S. Pat. Nos. 2,937,098 and 3,163,547 (incorporated herein by reference thereto) are also advantageously used in the gel compositions. These are generally provided in relatively small proportions as emulsions in alcohols such as isopropyl alcohol. Particularly useful are the anionic or cationic perfluorinated surfactants, such as the perfluorinated sulphonic acids having the general formula:

$$C_nF_{2n+1}SO_3H$$

where $C_n$ denotes an aliphatic chain, straight or branched containing from 5 to 20 carbon atoms. The acids are toxic and because of this suitable salts such as the alkali metal salts, for example, the sodium or potassium salts are preferably used. An example of a particularly suitable perfluorinated surfactant is that having the formula $C_8F_{17}SO_3NH_4$. Perfluorinated surfactants are commercially available from the 3M Company, Minneapolis, Minn. The perhalogenated surfactant is usually available in commerce in a mixed aqueous/organic solvent system and may be utilized in that form. A preferred emulsion product is Zonyl FSN, a fluorocarbon surfactant composition containing 1.0% active ingredient; E. I. DuPont DeNemours and Company, Wilmington, Del. When added to the compositions of the invention, the solvent is dispersed and the surfactant precipitates as a film, forming on the solid particles dispersed in the gel carrier.

Advantageous to the invention which includes the use of the dry powders described above, is the presence of a phosphorus containing antiflocculent, which is compatible with fire-extinguishing agents. Representative of antiflocculents containing phosphorus are compounds such as the phosphoric acid ester salts like alkylphosphates, alkyl ether phosphates, and alkylallyl ether phosphates.

Preferred phosphorus containing antiflocculents are the acidic phosphorus-containing compounds, for example, the water-soluble di- or polyphosphonic or di- or polyphosphinic acid esters or water-soluble salts thereof. Representative of the phosphonic or phosphinic acid esters or salts thereof are those of the general formulae (II) to (VI) as follows:

$$P_2—(X)_n \quad \text{(II)}$$

$$[P(X)_n]_3N \quad \text{(III)}$$

$$[[P(X)_n]_2N]_2(X)_n \quad \text{(IV)}$$

$$[[P(X)_n]_2N(X)_nP \quad \text{(V)}$$

$$[P(X)_n]_2N\ (X)_n]_3N \quad \text{(VI)}$$

where P represents a phosphonic or phosphinic acid radical or water-soluble salt (preferably ammonium) of such a radical;

N represents a nitrogen atom,

X represents the methylene or substituted meth-ylene radical —$CR_2$ or, where $X_n$ is directly bonded to 2 nitrogen atoms and n is greater than 1, two adjacent X groups may represent a part of a cycloalkyl, preferably a cyclohexyl, group, n represents a whole number from 1 to 5, R represents —H, —OH or —$(CH_2)_2H$ or part of a shared cycloalkyl group.

Compounds according to the above general formulae (II)–(VI) are widely available commercially usually as solutions, e.g. of 50% to 75% by weight, in water, for example from the Monsanto Company, St. Louis, Mo., under the Trade Name Dequest®. Although these compounds are provided in aqueous solution, because limited proportions are used, the overall contribution of water to the total composition of the invention is negligible and the total gel composition is substantially "non-aqueous" in nature.

Specific preferred compounds are:

Formula (II)

1-hydroxyethylidene 1,1-diphosphonic acid (Dequest® 2010) and the tetra sodium salt thereof (Dequest® 2016)

Formula (III)

aminotrimethylene phosphonic acid (Dequest® 2000)

Formula (IV)

ethylenediaminetetra (methylene phosphonic acid) ammonium salt (Dequest® 2042) and the hexamethylenediamine variant of the last compound (Dequest® 2052)

Formula (V)

diethylenetriaminepenta (methylene phosphonic acid) (Dequest® 2060).

Similar products are also available under the Trade Names "Mykon" PO60 and "Briquest" APPA 60A.

The phosphonic or phosphinic acid salts are employed in an anti-flocculent proportion, which is generally within the range of from 0.5 to 10 percent by weight of the total gel composition of the invention.

Those skilled in the art will appreciate that ammonium polyphosphate, described above as a preferred dry powder fire-extinguishing agent ingredient are also, inherently, antiflocculents.

The fire extinguishing compositions 18 may also be overpressured to facilitate discharge, with non-flammable gases such as nitrogen, carbon dioxide, helium, argon and like inert gases, using conventional techniques.

The following examples and preparations describe the manner and process of making and using the invention and set forth the best mode contemplated by the inventors of carrying out the invention but are not to be construed as limiting the invention.

Official (FAA) Laboratory Waste Basket Test (OLWBT):

This test is conducted in a furnace chamber having dimensions of 16"×18"×8". An electrical resistance heater is mounted in the bottom of the chamber and the tubular containers of the invention were suspended in the ceiling, approximately 12" above a tray covering the resistance heater. The tray was filled to capacity with crumpled paper. (Paper towels). The heater was energized, raising the temperature in the furnace until the papers ignited. Temperatures were recorded at the top of the furnace, center of the furnace and on the wall of the tubular containers.

PREPARATION 1

A composition is prepared by dispersing 100.4 gms of ammonium polyphosphate having an average particle size of 30 microns in 120.3 gms of 1,1,1,2-tetrafluoroethane (HFC-134a; gelled with 2.0 gm of fumed silica/alumina (Coke® 84, DeGussa, Inc., Teterboro, N.J., and containing 1.0 gms of polyoxyethylene sorbitol (Tween® 80, ICI, Wilmington, Del.) 0.1 gms of Zonyl® FSN fluorosurfactant, supra., and 2.0 gms of an anti-flocculent (Dequest® 2016; Monsanto Company, St. Louis, Mo.). The Preparation is a stable dispersion of low ozone depletion potential and is highly effective in extinguishing Class B and Class C fires. Some are also useful to extinguish Class A and Class D fires as defined by the National Board of Fire Underwriters. They are effective when applied in both "streaming" and "flooding" applications.

EXAMPLES 1–3

The Preparation 1. is charged to tubular containers of extruded nylon 12, 12 having a wall thickness of 1.0 mm, under a pressure of about 80 PSI.

This procedure was repeated three times, with tubular containers of various diameters. The diameters, charged weights, weights after expulsion and percentages of expulsion are set forth in the Table 1, below.

TABLE 1

| TEST # | TUBE I.D. | CHARGE WEIGHT (grams) | GROSS WEIGHT (grams) | POST FIRE WEIGHT | NET AGENT EXPELLED (grams) | % EXPULSION |
|---|---|---|---|---|---|---|
| 1. | ⅜" | 363 | 930 | 670 | 260 | 71.63 |
| 2. | ¼" | 370 | 860 | 510 | 350 | 94.59 |
| 3. | ⅜" | 422 | 1005 | 605 | 400 | 94.79 |

TABLE 2

| Test No. | Approximate Temperature (° F.) at Time of Container Rupture At Top of Furnace | Center | Container Wall | Approximate Time (SEC) of Rupture |
|---|---|---|---|---|
| 1. | 150 | 420 | 200 | 3.2 |
| 2. | 120 | 1400 | 100 | 2.3 |
| 3. | 320 | 500 | 350 | 3.5 |

(OLWBT)

EXAMPLE 4

An intermediate-scale apparatus is set-up to mimic a post-crash vehicle underhood environment. The device incorporates a fuel delivery system, an agent delivery system, and a combustion zone. the frame of the apparatus is rectangular with internal dimensions 70 cm wide by 90 cm long by 40 cm in depth, yielding a volume of 0.25 $m^3$. Walls surround the enclosure on four sides. the bottom is open and raised off the ground 10 cm. the top of the enclosure is 5 cm off the frame. the enclosure is partially filled (40% by volume) with rectangular aluminum boxes. the fuel is heptane in the form of a 50 ml pool fire and a fuel leak of ≈1.5 ml/s.

Placed in the top of the enclosure are a plurality of nylon 12, 12 tubular containers, ⅜" inner diameter, charged with 292 gms of Preparation 1, supra. A fire was ignited. The temperature 40 cm above the pool fire reached 600° C. in about 100 seconds, rupturing a tubular container, releasing the Preparation 1. The fire was extinguished in about 3.5 seconds.

Figure 3:
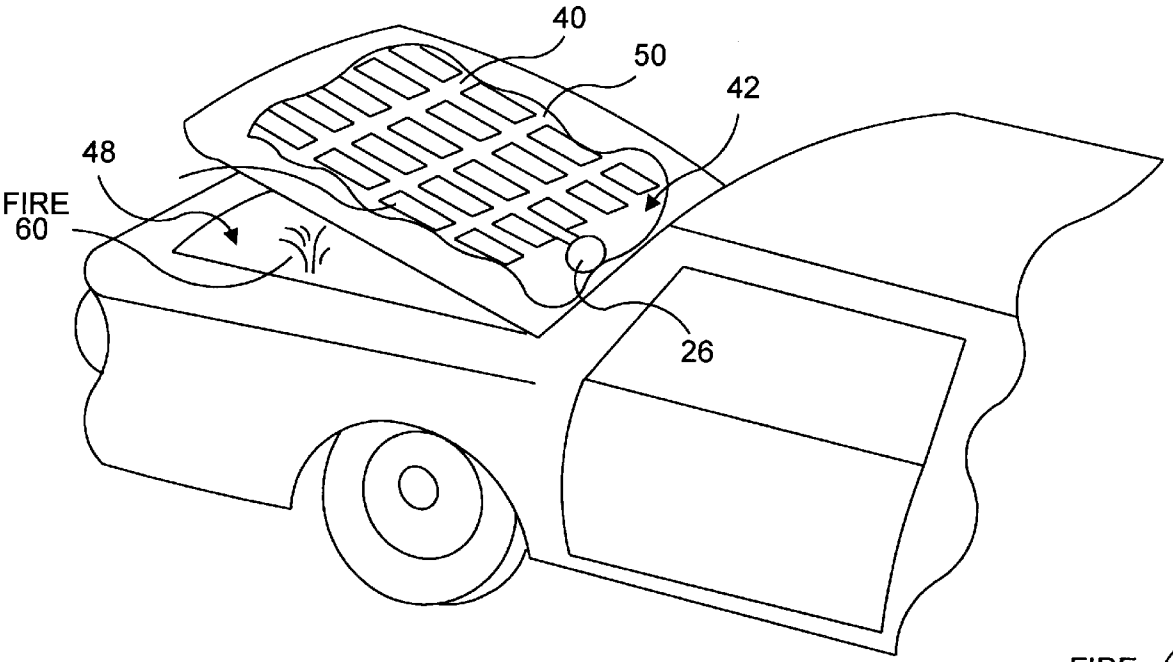
FIG. 3 is a view-in-perspective of an alternate embodiment apparatus of the invention, which is molded in a configuration to protect the engine compartment of a vehicle and usable with the general system shown in FIG. 1.

The fire-extinguishing apparatus 12 of the invention, which comprises the elongate containers 17 may be used in a variety of ways and may be fabricated to customize an installation. Referring to FIG. 3, a view-in-perspective of an alternate embodiment apparatus fire-extinguishing head 40 of the invention, designed for example to protect the engine compartment of a motor vehicle. The tubular container 17 is in the form of a waffle 50 shaped to be installed on the inner surface 42 of a hood 46 enclosing the engine compartment 48. In operation, if a fire erupts in the engine compartment 48, the open flame will soften a site 60 on the waffle 50, rupturing the container 17, whereupon there is a release of the fire-extinguishing composition 18 into the engine compartment 48 at the site 60 of flame.

Figure 4:
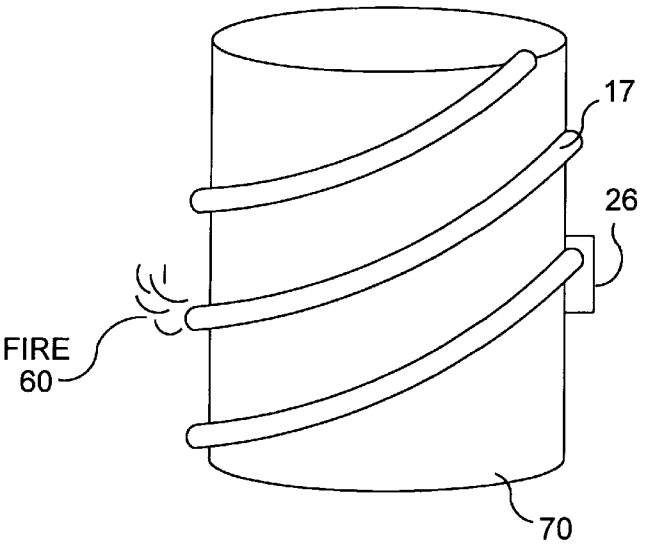
FIG. 4 is a view-in-perspective of an alternate embodiment apparatus of the invention, shown in-situ to protect a fuel storage tank from adjacent flame break-out sites.

FIG. 4 is a view-in-perspective of another alternate embodiment apparatus of the invention, shown in-situ to protect a fuel storage tank 70 from adjacent flame break-out sites 60. The tube is wrapped helically about the tank 70.

What is claimed is:

1. A linear fire extinguisher system, which comprises;

(a) an elongated tubular container with closed first and second ends;

said tubular container with first and second ends having side walls defining a closed, elongate chamber;

said tubular container side walls being molded of a thermoplastic, synthetic polymeric resin; which is substantially impermeable to leakage of the fire-extinguishing composition described below; and said container walls being adapted by size and material of fabrication to rupture under superatmospheric pressures upon reaching a flame temperature; and (b) an effective proportion of a substantially non-aqueous fluid fire extinguishing composition contained in the elongate chamber under superatmospheric pressures at temperatures below a flame temperature;

said fire-extinguishing composition comprising a gas selected from the group consisting of a perfluorocarbon, a hydrochlorofluorocarbon and a hydrofluorocarbon into which there is dispersed particles of dry powder fire-extinguishing agent having average particle sizes of a maximum of 500 microns;

said fire-extinguishing composition being a gel having a yield stress of at least about 200 dynes per $cm^2$ incorporating a surfactant and deflocculant stabilizing system.

2. The system of claim 1 wherein the resin is a polyamide.

3. The system of claim 1 wherein the resin is nylon 12, 12.

4. The system of claim 1 wherein the resin is nylon 12.

5. The system of claim 1 which further comprises:

(a) storage means for holding under super-atmospheric pressures a fluid fire extinguishing composition; and (b) open conduit means resistant to super-atmospheric pressures connecting the storage means for holding to the elongate chamber and providing open communication between the storage means and the elongate chamber.

6. A method of fire-extinguishing which comprises; providing a system of claim 1; and locating the system of claim 1 at a site of potential flame.

7. The system of claim 1 wherein the dry powder fire-extinguishing agent is ammonium polyphosphate.

8. The system of claim 7 wherein the ammonium polyphosphate has the general formula $$(NH_4)_n+2P_nO_{3n+1}$$

wherein n is an integer of at least about 17.

9. The system of claim 8 wherein n has a value between 1000 and 3000.

10. The system of claim 9 wherein the ammonium polyphosphate particles have an apparent density between about 0.4 and 0.9.

11. The system of claim 7 wherein the particle sizes are within the range of 1 to 100 microns.

12. The system of claim 11 wherein the average particle size is within the range of 1 to 12 microns.

13. The system of claim 7 wherein the proportion of gas in the gel ranges from 30 to about 99 percent by weight of the entire gel composition.

14. The system of claim 13 wherein the proportion is from about 40 to 98 percent.

15. The system gelled with fumed silica/alumina.

16. The system of claim 7 wherein the surfactant and deflocculation system comprises: from about 0.5 to 10 percent by weight of the gelled composition of a non-ionic surfactant; a depolarizing proportion of an anionic surfactant; 0.001 to 0.5 parts by weight of the total gel composition of a film-forming fluorocarbon; and 0.5 to 10 percent by weight of the gel composition of a phosphoric or phosphinic acid ester or salt thereof of the general formula (II) to (VI) below:

$$P_2\text{-}(X)_n \quad \text{(II)}$$

$$[P(X)_n]_3N \quad \text{(III)}$$

$$[[P(X)_n]_2N]_2(X)_n \quad \text{(IV)}$$

$$[[P(X)_n]_2N(X)_nP \quad \text{(V)}$$

$$[[P(X)_n]_2N(X)_n]_3N \quad \text{(VI)}$$

where P represents a phosphonic or phosphinic acid radical or water-soluble salt of such a radical;

N represents a nitrogen atom,

X represents the methylene or substituted methylene radical —$CR_2$ or, where $X_n$ is directly bonded to 2 nitrogen atoms and n is greater than 1, two adjacent X groups may represent a part of a cycloalkyl, preferably a cyclohexyl, group, n represents a whole number from 1 to 5, and R represents —H, —OH or —$(CH_2)_2H$ or part of a shared cycloalkyl group.

* * * * *